United States Patent [19]

Jonker

[11] Patent Number: 5,009,335

[45] Date of Patent: Apr. 23, 1991

[54] DISPLAY DEVICE FOR FLAT ARTICLES

[76] Inventor: Robert G. C. Jonker, Toernooiveld 24, 4902 PH Oosterhout, Netherlands

[21] Appl. No.: 430,019

[22] Filed: Nov. 1, 1989

[51] Int. Cl.[5] ..... B42F 7/00

[52] U.S. Cl. ..... 211/55; 211/128

[58] Field of Search ..... 211/55, 128, 113, 117, 211/118

[56] References Cited

U.S. PATENT DOCUMENTS

| | | | |
|---|---|---|---|
| 1,155,763 | 10/1915 | Shirley | 211/55 X |
| 1,378,959 | 5/1921 | Holt | 211/55 X |
| 1,455,192 | 5/1923 | Dumont | 211/55 X |
| 1,650,663 | 11/1927 | Swoboda | 211/55 X |
| 1,678,275 | 7/1928 | Spearman | 211/55 |
| 2,283,546 | 5/1942 | Fischer | 211/55 X |
| 2,798,617 | 7/1957 | Schreiber | 211/55 X |
| 3,198,340 | 8/1965 | Tokash | 211/55 X |

FOREIGN PATENT DOCUMENTS

| | | | |
|---|---|---|---|
| 684940 | 12/1939 | Fed. Rep. of Germany | 211/55 |
| 1611751 | 3/1968 | Fed. Rep. of Germany . | |
| 994654 | 11/1951 | France | 211/55 |
| 2091539 | 11/1981 | United Kingdom . | |

*Primary Examiner*—Blair M. Johnson

*Attorney, Agent, or Firm*—Wegner, Cantor, Mueller & Player

[57] ABSTRACT

A device for displaying flat articles, such as a book, gramophone record, card etc., which device is substantially provided with a frame 1 and a number of horizontally extending carrier elements 6 for these particles supported by the frame, whereby each carrier element is manufactured from a strip of plate material that is bent over along lines running in lengthwise direction in order to obtain a substantially U-shaped cross section having legs of different length, whereby the free edge 8 of the long leg 7 is folded outward over more than 90°, and whereby the frame is provided with at least one suspension member fitting in the fold in addition to at least one support means 2 extending downwards from that member, as a result of which a loose chain of elements 6 can be formed, of which the height and angle of slope can be adapted to any purpose of use.

12 Claims, 4 Drawing Sheets

113
113
45°
11
111'
111'
2
112
113
112
111
111
113
112
113
111
112
111
112
5
3
111
112
113
113
112
2

DISPLAY DEVICE FOR FLAT ARTICLES

The invention relates to a device for displaying flat articles, such as a book, gramophone record, card etc., which device is substantially provided with a frame and a number of horizontally extending carrier elements for these articles supported by the frame.

Such a display device or display case is usually manufactured from plate material, such as fibre plate, whereby the frame and the carrier elements form a rigid entity with one another such that a shelf-free case construction is created. The drawback of such a construction is that this case together with the elements is difficult to adapt to the location where the case is used.

An object of this invention is to provide a display device that consists of a limited number of components, that is simple to assemble and simple to adapt to the location of use with respect to dimension and form.

The device according to the invention is distinguished in that each carrier element is manufactured from a strip of plate material that is bent along lines running in lengthwise direction in order to obtain a substantially U-shaped cross section having legs of different length, whereby the free edge of the long leg is folded outward over more than 90°, and whereby the frame is provided with at least one suspension member fitting in the fold in addition to at least one support means extending downwards from that member.

Owing to the U-shaped carrier elements with legs of different lengths it is possible to hook these elements to each other with the result that a loose chain of elements is formed, the height of which can be adapted to any requirement. The chain of carrier elements is only suspended from the frame on the upper suspension member with the result that the latter acquires the function of a purely supportive member whereby the carrier elements do not have to be further fixed to the frame. In this way the angle of slope as well as any change in the angle of slope can be easily adapted to the purpose of use.

In order to achieve greater widths of the device the elements have only to be suspended adjacent to each other so as to obtain a continuous carrier element for the products for display.

Above mentioned and other features of the invention will be further elucidated in the figure description of two embodiments following hereinafter.

DESCRIPTION OF THE PREFERRED EMBODIMENTS

Figure 1:
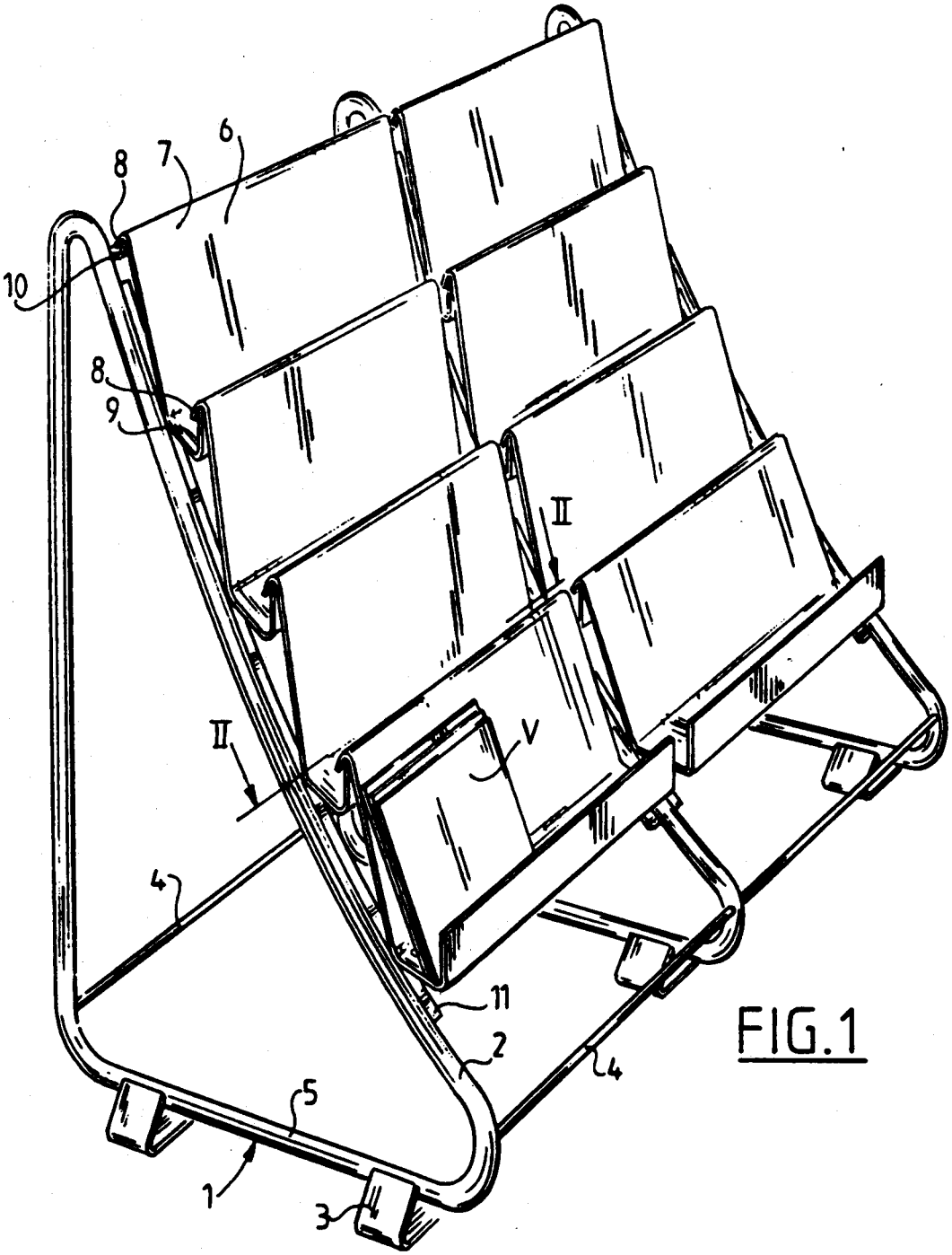
FIG. 1 shows a perspective front view of a first embodiment of the device according to the invention.

Designated in the figures with the numeral 1 is the supporting frame which consists in the embodiments shown of a framework of tubular material. The side surface is thus formed by a bent tube 2 which displays a substantially triangular shape. The tube form can be of any suitable material and bent in any suitable manner. The tubular side parts 2 are mutually joined by cross members 4, thus obtaining a spatial construction whereby it is noted that the bottom portions 5 of the tubular side parts 2 are each provided with support brackets 3.

The frame 1 bears a number of carrier elements 6, each of which are built up according to the invention from a strip of plate form material, for instance metal, which is bent such that a cross section results in the form of a U with legs of different lengths.

The free edge strip of the long leg 7 of the U-shaped profile is folded over sharply to the rear or outwards in order to obtain a suspension strip 8. The carrier elements are all of equal length, which can be a random length depending on the purpose of use and the material used.

Owing to the profiling of the plate material it becomes comparatively stiff as a result of the formed ridges, so that longer elements can be formed.

It should be noted that the body portion 9 of the U-shaped profile encloses an obtuse angle with the long leg 7 of the U-profile as opposed to an acute angle with the short leg. This ensures that under the influence of gravity articles placed in the carrier elements are situated with their rear side at an interval from the front surface of the profile, which prevents the articles falling out of the carrier elements.

As a result of the folded over strip 8 the elements 6 can be suspended on each other which results in a vertical chain, so that the number of elements 6 determines the height of the display.

Only the frame 1 is provided at the top with a suspension member 10 in the form of a cross member extending between the tubular side parts 2.

In addition each of the tubes is formed on the sides facing one another with a support means 11 in the form of a flat profile which extends downwards from the suspension member 10. The ends of each carrier element 6 rest on the upper surface of this support means and it will be apparent that as a result of the sloping position of the foremost part of the tubular elements 2, and thereby the sloping position of the support means 11, further fixing of the elements 6 on this support means 11 becomes superfluous.

Figure 2:
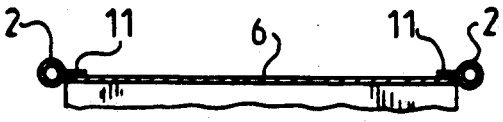
FIG. 2 is a cross section along the line II—II in FIG. 1.

If the element 11 in strip form is arranged in the middle of the tube 2, see FIG. 2, there is also created a sideways bounding of the U-shaped profiles of the carrier elements 6 that are open at either side. This bounding serves to contain articles displayed on the carrier elements 6.

By arranging the strip-form support means 11 not in the middle but continuously along the tube 2 there can result continuous U-shaped profiles of adjacently positioned elements 6.

Figure 3:
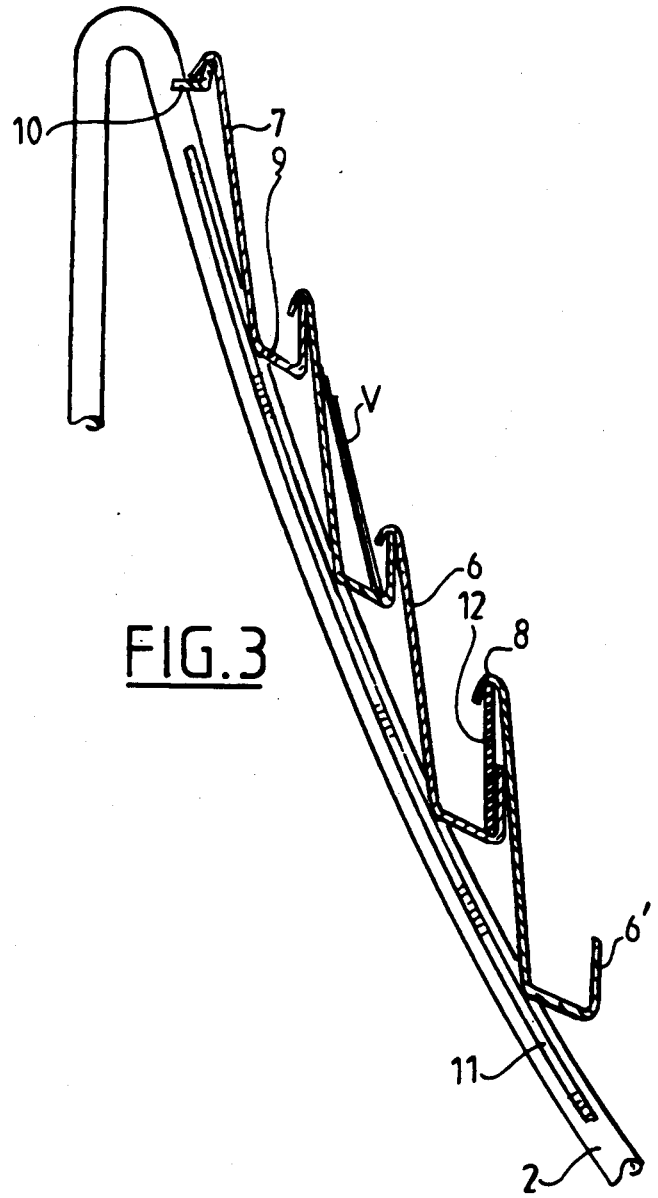
FIG. 3 shows on enlarged scale a side view of a portion of the device from FIG. 1.

The pitch distance between elements 6 of the downward hanging chain can easily be altered by the insertion of additional support strips 12, see FIG. 3, this strip being placed in the inside of a U-shaped profile of a carrier element 6, after which the folded over edge strip 8 of the following element 6' can be hung round the upper edge of the strip 12. In this way the distance between successive elements 6, 6' is reduced. This is of advantage in the case of articles V of different height. It will also be apparent from the above that the angle of slope over which the mutually suspended elements 6 extend can easily be altered by changing the angle of the foremost part of the tubular element 2 relative to the vertical.

Figure 4:
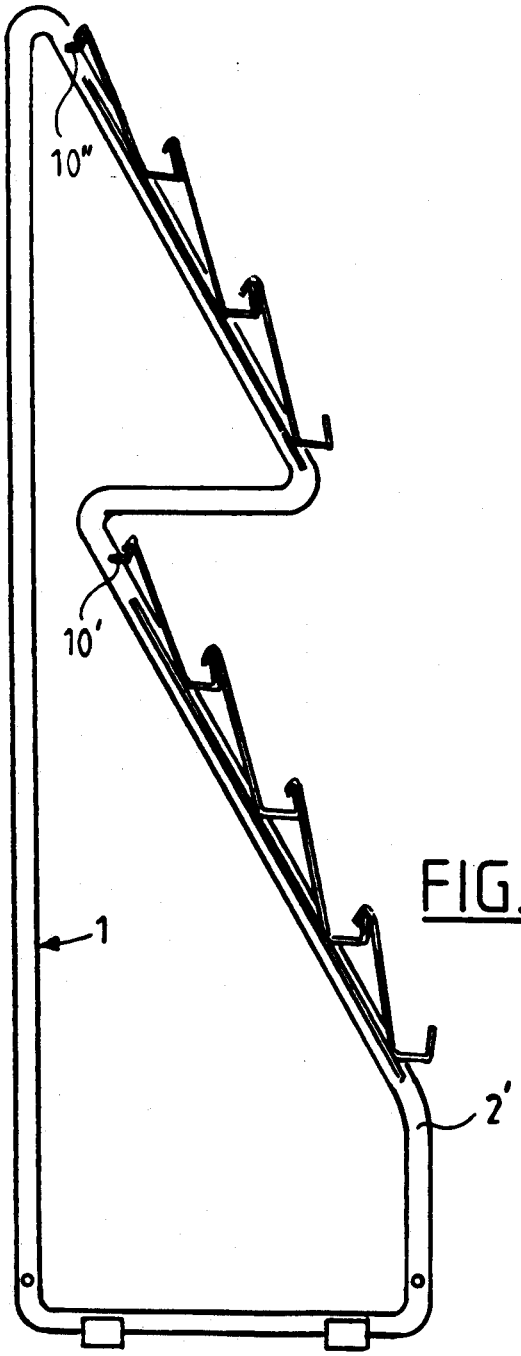
FIG. 4 is a side view corresponding with FIG. 3 of a second embodiment of the display case according to the invention.

It is further possible to give the foremost part of the tubular element 2 a portion with a double slope, see 2' in FIG. 4, as a result of which chains of carrier elements 6 located above one another can be obtained. Each chain has its own respective suspension member 10' and 10" of the frame 1.

Figure 5:
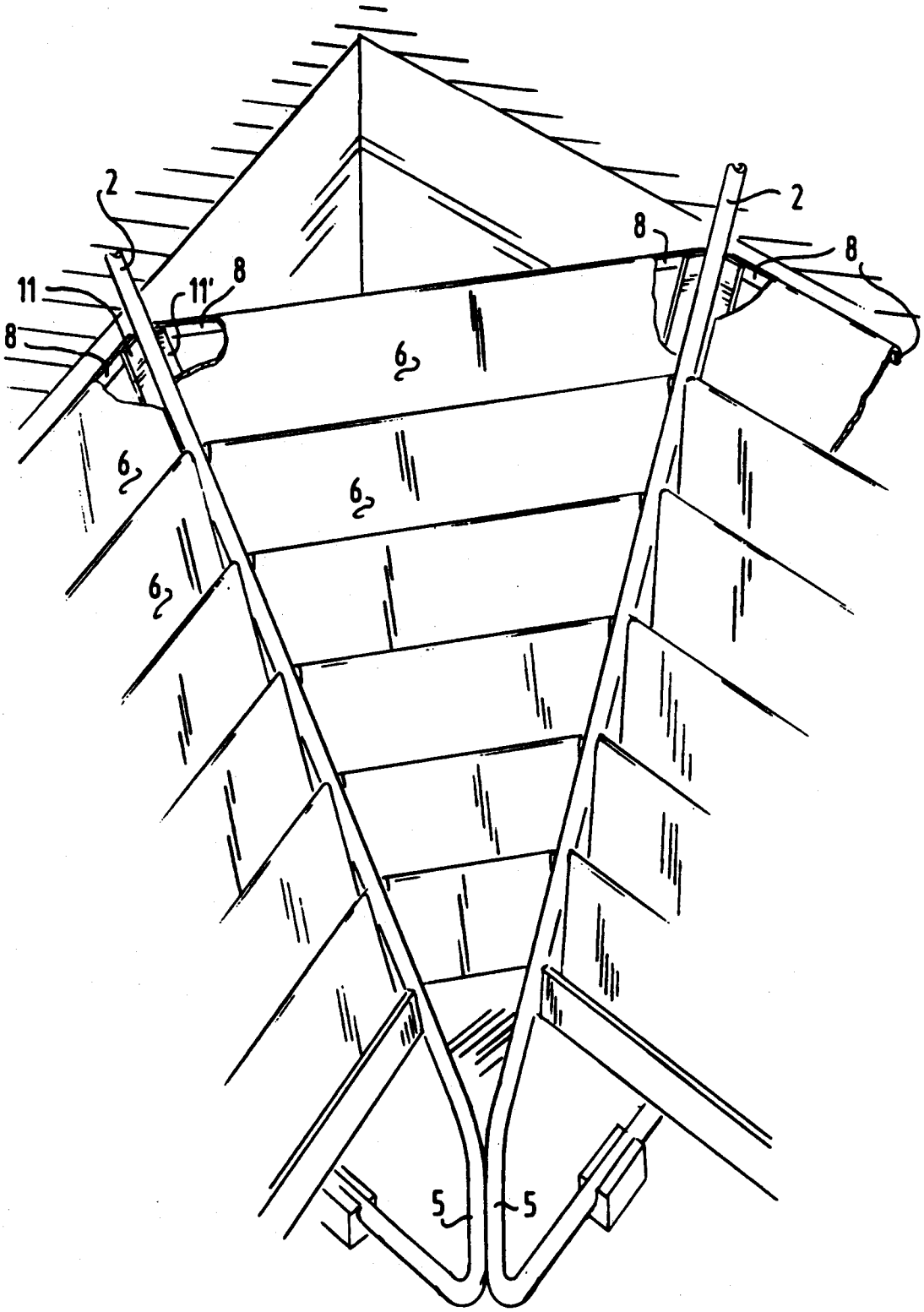
FIG. 5 is a perspective front view of a third embodiment applicable in a corner of a room.

Turning now to the embodiment of FIG. 5 it is noticed that the same reference numerals are used for the same elements as described above.

The embodiment according to FIG. 5 is adapted to be placed in a corner of a room or the like wherein the side surface of the supporting frame of two adjacent display devices are on a distance to each other, as the bottom parts 5 lies further from the wall of the room than the proportions of the side frame. Therefore the corner could not be covered by the elements 6 in the way as described and disclosed in FIG. 1. The side frame portions formed by a tube 2 is provided with a strip element 11 extending under a certain angle, for instance 45° with respect to the support strip 11 of the display according to FIG. 1.

The corner display can be provided with a support strip 8 to suspend the upper element 6, said element being cut obliquely at both outer side parts in order to fit in between the tube like members 2 of the adjacent display devices.

The lower elements 6 are cut in the same way obliquely and will be suspended to the upper elements while resting on the support strips 11, 11' in order to form a upside down triangular display device for the corner.

Figures 6, 7, 8:
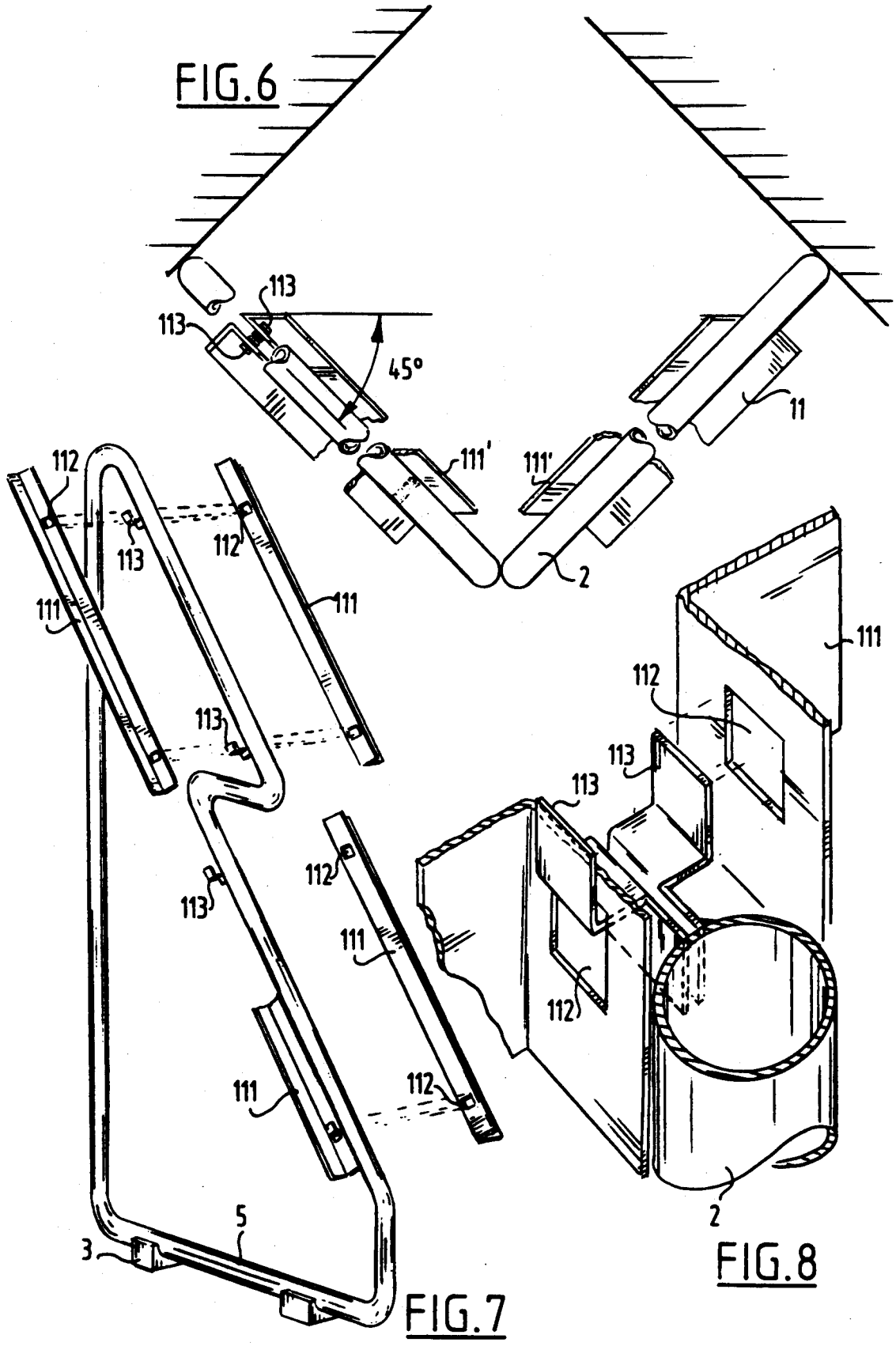
FIG. 6 is a top view of the third embodiment according to FIG. 5.
FIG. 7 is a perspective front view as in FIG. 1 related to an alternative embodiment of the support means.
FIG. 8 is a perspective top view of a detail on an enlarged scale of the embodiment in FIG. 7.

The strip like elements 11 are shown to be welded or the like to the tube elements 2, but according to a further embodiment as depicted in FIG. 7 and 8, the strip elements 111 can be L-shaped. One flange of the L-shaped strip 111 is provided with holes 112, each of which cooperates with a bracket 113 welded to the tube 2.

As clearly shown in FIG. 8 the rear strip 111 is in the position to be placed upon the bracket 113, whereas the front strip 111 is already placed in position on the brackets 113.

So the inner side of each side wall made by tubes of other profiled elements can be provided with a L-shaped strip 111 in order to form the support means for the display elements 6. In this embodiment it is not necessary to have left and right shaped side frame units as necessary in the embodiment according to FIG. 1, but those frame units can be place where applicable, whereas the strip element 111 can be suspended to the brackets 113 in any suitable position.

To form a corner display unit as depicted in FIG. 5 the strip-like member 1, 111 is not provided with flanges under 90° but applies for a stip-like member 111' having the flanges under 45°.

It will be apparent from the above that the height, the width and the number of chains formed by mutually suspended elements depend on the shape of the side parts 2. This can be formed in any arbitrary manner by employing profile material, for example a tube, and bending and welding it together, with the proviso that a support means extends sloping downward from a suspension member. The device can be further perfected using purely standard components consisting of a U-shaped carrier element for the articles having legs of different lengths.

What is claimed is:

1. A device for displaying flat articles comprising:

a frame;

at least one substantially horizontal suspension member supported by the frame;

a plurality of carrier elements for holding said flat articles, each carrier element including a body portion comprising a first substantially planar surface having a front edge and a rear edge; lower engagement means comprising a second substantially planar surface extending upwardly from said front edge of said first substantially planar surface; a back portion comprising a third substantially planar surface extending upwardly from said rear edge of said first substantially planar surface, wherein said third substantially planar surface of the back portion extends further upwardly from the body portion than said second planar surface of the lower engagement means; and upper engagement means for overhanging said suspension member or the lower engagement means of another carrier element, said upper engagement means comprising a hook-like suspension strip along an upper edge of the third substantially planar surface of said back portion, wherein said hook-like suspension strip extends backwardly and downwardly from the upper edge of the third substantially planar surface, wherein the upper engagement means of a first carrier element overhangs the substantially horizontal suspension member, and the upper engagement means of a second carrier element overhangs the lower engagement means of said first carrier element; and at least one support means for supporting said first and second carrier elements in the vicinity of the rear edge of the body portions thereof, wherein said support means has the form of a strip which is releasably connected to the frame and extends downwardly from adjacent the suspension member.

2. The device according to claim 1, wherein the frame is constructed of tubular material and the support means is a lengthwise strip extending from a tubular framing member.

3. The device according to claim 1, wherein an angle formed at the rear edge of the body portion, between the first substantially planar surface of the body portion and the third substantially planar surface of the back portion, is an obtuse angle.

4. The device according to claim 3, wherein an angle formed at the front edge of the body portion, between the first substantially planar surface of the body portion and the second substantially planar surface of the lower engagement means, is an acute angle.

5. The device according to claim 1, wherein the lower engagement means further includes a support strip extending upwardly from the body portion, said support strip extending further upwardly from the body portion than the second planar surface of the lower engagement means, whereas the third substantially planar surface of the back portion extends further upwardly from the body portion than the support strip.

6. The device according to claim 1, wherein the frame is provided with at least two brackets, and the strip of the support means is provided with at least two orifices adapted to cooperate with said at least two brackets.

7. The device according to claim 1, wherein at least a pair of carrier elements are positioned in a non-parallel relationship to each other.

8. The device according to claim 1, wherein the support means extends slopingly downward from the substantially horizontal suspension member.

9. The device according to claim 1, further including a second substantially horizontal suspension member located below the other substantially horizontal suspension member, wherein the upper engagement means of a third carrier element overhangs the second substantially horizontal suspension member, and the upper engagement means of a fourth carrier element overhangs the lower engagement means of said third carrier element.

10. The device according to claim 1, wherein the frame includes two tube elements, the substantially horizontal suspension member connects the two tube elements, and the support means are connected to each of the two tube elements.

11. The device according to claim 10, wherein the two tube elements are substantially parallel to each other.

12. The device according to claim, wherein the two tube elements are parallel to each other.

* * * * *